US005122784A

United States Patent [19]

Canova

[11] Patent Number: 5,122,784

[45] Date of Patent: Jun. 16, 1992

[54] METHOD AND APPARATUS FOR COLOR CONVERSION

[75] Inventor: Frank J. Canova, Tokyo, Japan

[73] Assignee: International Business Machines Corporation, Armonk, N.Y.

[21] Appl. No.: 406,926

[22] Filed: Sep. 13, 1989

[30] Foreign Application Priority Data

Sep. 14, 1988 [JP] Japan ..... 63-228495

[51] Int. Cl.[5] ..... G09G 1/16; G09G 1/06

[52] U.S. Cl. ..... 340/703; 340/701; 340/728

[58] Field of Search ..... 340/723, 721, 703, 701, 340/793; 358/30; 364/521; 240/728, 750

[56] References Cited

U.S. PATENT DOCUMENTS

| | | | |
|---|---|---|---|
| 4,704,605 | 11/1987 | Edelson | 340/728 |
| 4,733,230 | 3/1988 | Kurihara et al. | 340/703 |
| 4,739,312 | 4/1988 | Oudshoorn et al. | 340/703 |
| 4,763,283 | 8/1988 | Coutrot . | |
| 4,924,413 | 5/1990 | Suwannukul | 340/701 |
| 4,977,398 | 12/1990 | Pleva et al. | 358/30 |
| 4,980,678 | 12/1990 | Zenda | 340/784 |

FOREIGN PATENT DOCUMENTS 3240473 5/1984 Fed. Rep. of Germany .

OTHER PUBLICATIONS

A. A. Arismendi et al., "Color on Color Character Attribute Mapping Implementation for a Liquid Crystal Display", IBM Technical Disclosure Bulletin, vol. 29, No. 2, Jul. 1986, pp. 811–812.

*Primary Examiner*—Alvin E. Oberley
*Assistant Examiner*—Steven J. Saras
*Attorney, Agent, or Firm*—Bernard E. Shay; David Aker

[57] ABSTRACT

A method and an apparatus for color conversion of n-bit color data to m-bit color data (where n is greater than m). New color data bytes and original color data bytes are compared for a current pixel and a previous pixel immediately preceding the current pixel, so that any change in the original color data is reflected in the new color data. This is done by changing the current pixel when a match of the new color data bytes and a mismatch of the original color data bytes occurs. The invention is especially useful for maintaining contrast between text and background.

12 Claims, 2 Drawing Sheets

NEW COLOR DATA
2
26
ADDER
+1
-1
10
22
24
28
A > B
30
A < B
32
A=B
20
2 COMP
A
B
16
1 COMP
A
B
18
2 DELAY
14
1 DELAY
12
LOOKUP TABLE
8
2
ORIGINAL COLOR DATA
NEW CHARACTER FLUSH

METHOD AND APPARATUS FOR COLOR CONVERSION

The present invention relates to a method and an apparatus for color conversion, and in particular to a method and an apparatus for converting n-bit color text data to m-bit (where n is greater than m) color text data.

BACKGROUND OF THE INVENTION

By improvement of CRT displays and CRT controllers for controlling them, high-performance displays exhibiting a 1000×1000 resolution and over 16 million displayable colors have recently appeared and are used in personal computers and workstations. On the other hand, laptop type personal computers, which employ a liquid crystal display or plasma display for the purpose of weight reduction and space saving have appeared. The problem here is color processing when a program written on the assumption of using a high-performance display is made to run on a laptop type personal computer. In this specification, the term "color" is used in a broad sense to include monochrome and gray scales.

At present, as regards displayable colors, so-called flat-panel displays such as liquid crystal and plasma displays are far from the level of CRT displays. However they are at a stage in which gray scale display with several levels is practically used. Accordingly, the ability to distinguish the large number of colors used in a program such as described above using a flat-panel display is a problem.

A typical conventional method is to use a lookup table for converting n-bit (e.g., 8-bit) color data to m-bit (e.g., 2-bit) color data having a smaller number of bits, the lookup table maps $2^n$ colors to $2^m$ colors. As another example, in IBM Technical Disclosure Bulletin, Vol. 29, No. 2, pp. 811-812, published in July 1986, a technique is disclosed in which a color enable register is used with a mapping scheme to display a character whose foreground and background colors are specified by an attribute byte. The character may then be displayed on a monochrome liquid crystal display.

In color mapping using a lookup table, different original colors may be mapped to the same color. However, text cannot be viewed if such mapping occurs in the foreground and background colors of the text. In the technique described in the above TDB, the foreground and background colors can be displayed distinguishably, but its application is limited to the monochrome display. In addition, when reverse video is utilized, the output of some displays would lose resolution.

The present invention provides a method and an apparatus for color conversion which clearly displays changes in the color data.

SUMMARY OF THE INVENTION

In converting an n-bit original color data byte supplied for each pixel to an m-bit (where n is greater than m) new color data byte, the present invention compares the new color data with each other and the original color data with each other with respect to a current pixel and a previous pixel which is a pixel immediately preceding the current pixel, to reflect any change in the original color data in the new color data.

More particularly, the present invention is directed to a color conversion method in which an n bit original color data byte is converted to an m bit new color data byte by means of, for example, a lookup table. Resolution between first and second pixels of different colors is maintained by comparing the new color data byte for the second pixel with the new color data byte for the first pixel. Second, or simultaneously, the original color data byte for the second pixel is compared with the original color data byte for the first pixel. Finally, the new color data byte for the second pixel is changed when the new color data byte is identical for the first and second pixel while the original color data byte is different for the first and second pixel.

In addition, the present invention is directed to an apparatus for maintaining resolution between first and second pixels of different colors during conversion from an n bit original color data byte to an m bit new color data byte. More particularly, two delay circuits and two comparators are provided to compare the color data byte of the current pixel and the color data byte of the previous pixel. A first comparator compares the original color data bytes and a second comparator compares the new color data bytes. If a mismatch of the original color data bytes and a match of the new color data bytes is detected by the first and second comparators, the new color data byte value of the current pixel is changed. In the embodiment described later, a pair of and gates are used to determine whether a mismatch has occurred while an adder is used to change the new color data byte. For conversion of the color data byte from n bits to m bits, it is desirable to use a lookup table which can be rewritten so that the number and types of new color data can be set arbitrarily as needed.

In one embodiment of the present invention a conversion means, for example a lookup table, is used to convert an n-bit original color data signal to an m-bit new color data signal (where n is less than m) and means for maintaining resolution between first and second pixels of different colors during the same conversion process. The means for maintaining resolution may include the following elements: A first delay means, for example a delay circuit, for storing the new color data byte for the first pixel. First comparison means, for example a comparator, for comparing the new color data byte for the second pixel with the delayed new color data byte for the first pixel output by the first delay means. Second delay means for storing the original color data byte for the first pixel.

Second comparison means for comparing the original color data byte for the second pixel with the delayed original color data byte for the first pixel. Means for detecting for example paired and gates, a mismatch between the original color data bytes for the first and second pixel, in addition to a match between the new color data bytes for the first and second pixel. Means for changing, for example an adder circuit, the new color data byte for the second pixel in response to outputs from the detecting means.

BRIEF DESCRIPTION OF THE DRAWINGS

The novel features of the invention are set forth with particularity in the appended claims. The invention itself, however, both as to organization and method of operation, together with further objects and advantages thereof, may best be understood by reference to the following description taken in conjunction with the accompanying drawings in which:

DESCRIPTION OF THE PREFERRED EMBODIMENT

Figure 1:
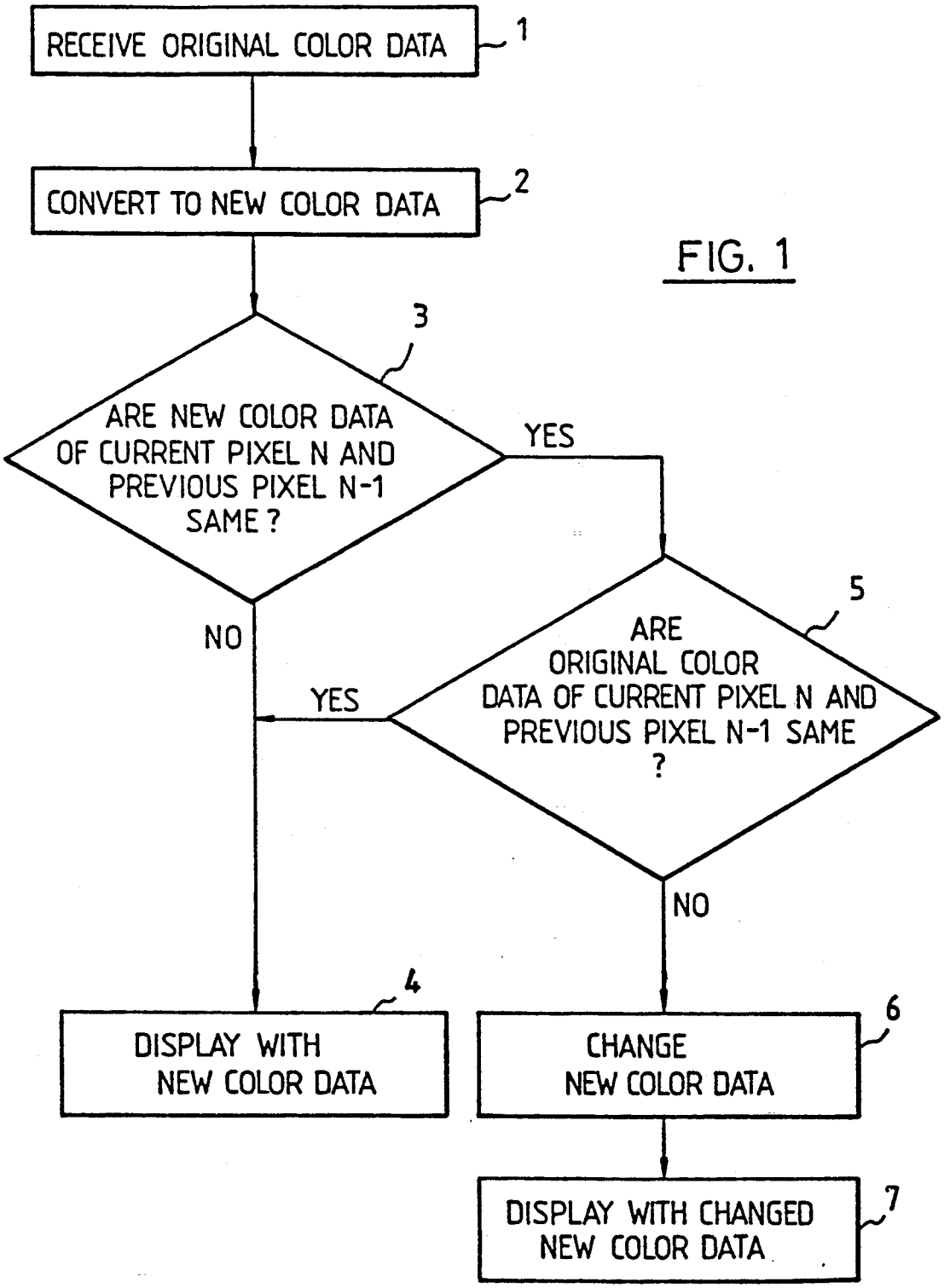
FIG. 1 is a flowchart showing a flow of color conversion according to the present invention.
Figure 2:
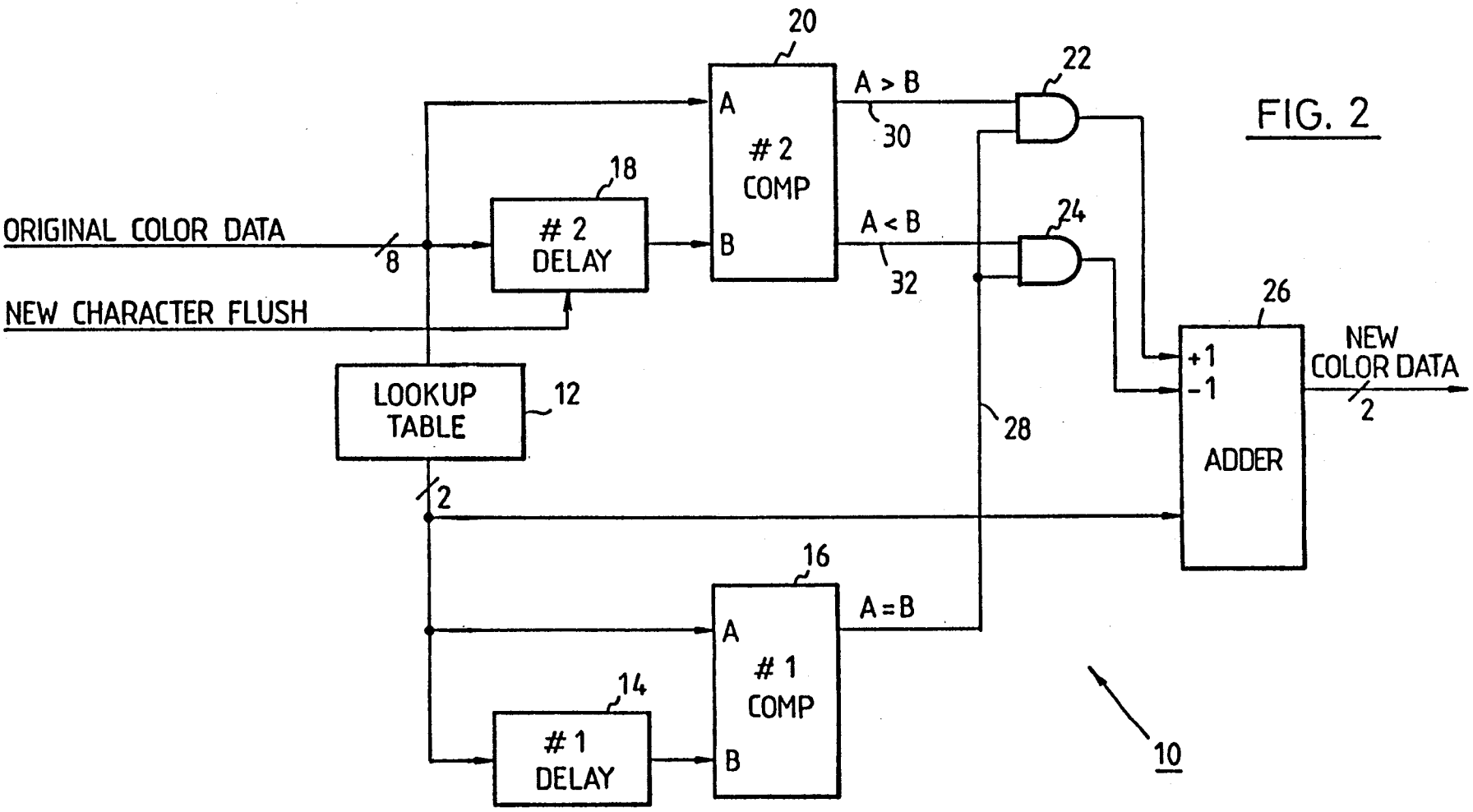
FIG. 2 is a block diagram showing a structural example of the color conversion apparatus according to the present invention.

A flow of color conversion according to the present invention is shown in FIG. 1, and a hardware structure therefor is shown in FIG. 2. In the following description, it is assumed that the number "n" of bits of the original color data byte is 8 and the number "m" of bits of the new color data byte after conversion is 2, but these numeric values may be any values provided that they satisfy the condition of n being greater than m..

In FIG. 1, the 8-bit original color data byte sent from a CRT controller for each pixel is received by a color conversion apparatus (FIG. 2) in the first step 1. This original color data byte represents one of 256 colors, which is a foreground or background color in the text mode. In the next step 2, the original color data byte is converted to a 2-bit new color data. For this conversion, a lookup table, as described later, can be used. The next step 3 is a decision step which checks whether the new color data byte for the current pixel N is the same as the new color data byte for the previous pixel N-1, which is a pixel immediately preceding the current pixel. The new color data byte represents a value of a pixel which is displayed on a display (e.g., liquid crystal display) that is not a multi-color display. If they are different, they can be distinguished from each other on a screen. Accordingly, if the decision result in step 3 is "no," the new color data byte converted in step 2 is directly used for display (step 4). The fact that the color data byte for the current pixel N is different from that for the previous pixel N-1 means that a boundary between the foreground and the background exists, but in some case, it may show a boundary between two character boxes which have different background colors.

On the other hand, if the new color data byte for the current pixel N is equal to that for the previous pixel N-1, they cannot be distinguished on a screen, but, if the original color data bytes are also equal, there is no color change, so there is no need to distinguish them. Therefore, if the decision result in step 3 is "yes," go to step 5 to check whether the original color data byte for the current pixel N is equal to that for the previous pixel N-1. If they are equal, go to the above described step 4 to use the new color data bytes converted in step 2 directly for display.

If the original color data bytes are different, the same new color data byte as the previous pixel N-1 has been generated for the current pixel N despite the fact that there was color change in the original text, so the color change in the original text is not reflected on a liquid crystal display screen unless something is done. Thus, if the new color data byte of the current pixel N and the previous pixel N-1 are the same and their original color data bytes are different, go to step 6 from step 5 to change the new color data byte. This change is preferably done according to a direction of change in the original color data bytes. Specifically, when the original color data byte values of the current pixel N and the previous pixel N-1 are assumed to be A and B, respectively, if A is greater than B, the new color data byte value is increased (e.g., +1), and if A is less than B, that value is decreased (e.g., −1). As a result, the color change in the original is reflected on a liquid crystal display screen. The last step 7 uses the new color data converted in step 6 for display.

The steps 1-7 of FIG. 1 are repeated whenever a new color data byte is received for each pixel from the CRT controller.

Now the color conversion apparatus for implementing the flow of FIG. 1 will be described with reference to FIG. 2. The color conversion apparatus 10 of FIG. 2 consists of a lookup table 12 for converting an 8-bit original color data byte from a CRT controller (not shown) to a 2-bit new color data byte, a first delay circuit 14 for delaying the output of the lookup table 12 by one pixel, a first comparator 16 receiving the output of the lookup table at its A input and receiving the output of the first delay circuit 14 at its B input, a second delay circuit 18 for delaying the original color data by one pixel, a second comparator 20 receiving the original color data at its A input and receiving the output of the second delay circuit 18 at its B input, two AND gates 22 and 24 for selectively gating the output of the second comparator in response to the output of the first comparator 16, and an adder 26 for selectively changing the new color data byte from the lookup table 12 in response to the outputs of the AND gates 22 and 24. The new color data byte outputted from the adder 26 at the final stage is supplied to a display (not shown) such as a liquid crystal or plasma display that is not a multi-color display. Explained in connection with FIG. 1, the original color data byte first received in step 1 is supplied to the lookup table 12, the second delay circuit 18 and the A input of the second comparator 20. Step 2 is executed by the lookup table 12. The lookup table 12 can be of any construction that is capable of color conversion from 8 bits to 2 bits (generally, from n bits to m bits, where n is greater than m), but in the point of general purpose, it is preferably a memory (particularly, a RAM) which receives the 8-bit original color data byte as an address. In that case, the selection of which data byte is to be written in each storage location of the memory can be made by the user, and this is not a part of the present invention. For a simple color conversion, a gate circuit which outputs as the new color data byte 2 specified bits of the 8 bits constituting the original color data may be used in place of the lookup table 12.

The 2-bit new color data byte obtained from the lookup table 12 is supplied, for execution of step 3, to the first delay circuit 14 and the A input of the first comparator 16. The first delay circuit 14 is for delaying the new color data byte by one pixel, and accordingly, when the new color data byte of the current pixel N is provided to the A input of the first comparator 16, the new color data byte of the preceding pixel N-1 is provided to its B input. Thus, step 3 becomes executable. The first comparator 16 activates the output line 28 only for A equal to B, partially conditioning the AND gates 22 and 24. In this embodiment, the outputs of the AND gates 22 and 24 are used as operands +1 and −1, respectively for the adder 26. The other operand to be supplied to the adder 26 is the 2-bit new color data. Therefore, if A not equal to B is detected in the first comparator 16 and neither AND gate 22 nor 24 is conditioned, the first operand is considered to be 0 and the adder 26 allows the new color data byte from the lookup table 12 to pass through with no change (step 4).

If A equal to B is detected in the first comparator 16, the AND gates 22 and 24 are partially conditioned by activation of the output line 28, but which AND gate is fully conditioned depends on the outputs of the second comparator 20. The second comparator 20 receives the 8-bit original color data byte from a CRT controller at its A input, receives the original color data byte delayed by one pixel in the second delay circuit 18 at its B input, and executes step 5 of FIG. 1. If A is equal to B, neither output line 30 nor 32 is activated and hence the AND gates 22 and 24 are not conditioned, so the adder 26 allows the new color data from the lookup table 12 to pass through with no change (step 4).

The second comparator 20 activates the output line 30 upon detecting that A is greater than B and activates the output line 32 upon detecting that A is less than B. In the former case, the AND gate 22 is fully conditioned to supply the +1 operand to the adder 26, and in the latter case, the AND gate 24 is fully conditioned to supply the −1 operand to the adder 26. This means that the same change direction as the change direction (increase or decrease direction) of the original color data from the previous pixel N-1 to the current pixel N is given to the new color data byte. The adder 26 outputs the 2-bit new color data byte from the lookup table 12 to a liquid crystal display after adding 1 to or subtracting 1 from it, depending on which AND gate 22 or 24, was fully conditioned (steps 6 and 7).

In the flowchart of FIG. 1, step 5 is executed after step 3, but as can be seen from the circuit diagram of FIG. 2, the comparison operations in these steps can be executed concurrently as far as the hardware is concerned.

For a typical color text, the foreground and background colors are specified for each character box. Accordingly, the background color may change at the boundary between characters. However, since the background color per se has almost no meaning as text data, it is not necessary to positively distinguish this. For this reason. in the embodiment of FIG. 2, the adder 26 does not change the new color data byte in the case of character change. This is accomplished by activating a new character flash signal to eliminate the delay in the second delay circuit 18 when the original color data byte inputted to the second delay circuit 18 changes from the background color of the previous character to the background color of the new character, which occurs at a character box boundary. As a result, the same original color data byte is applied to the A and B inputs of the second comparator 20 so that both output lines 30 and 32 are inactive, and the increment or decrement in the adder 26 is prohibited, whereby the new color data byte from the lookup table 12 is outputted with no change. The remaining operation is the same as that described above because the new color flash signal is inactivated thereafter.

In accordance with the present invention, when an n-bit original color data byte is converted to m-bit new color data (wherein n is greater than m), the change in the original color data can be reflected in the new color data. Also, the number and types of new color data can be set arbitrarily by changing the contents of a lookup table.

While preferred embodiments of the present invention have been shown and described herein, it will be obvious to those skilled in the art that such embodiments are provided by way of example only. Numerous variations, changes and substitutions will now occur to those skilled in the art without departing from the invention. Accordingly, it is intended that the invention be limited only by the spirit and scope of the appended claims.

What is claimed is:

1. A color conversion method comprising the steps of:

converting an n-bit original color data supplied for each pixel to an m-bit, new color data, where n is greater than m;

comparing the new color data with each other and the original color data with each other with respect to a current pixel and a previous pixel which is a pixel immediately preceding the current pixel; and changing the value of the new color data of said current pixel and sending it to a display unit when a match of the new color data and a mismatch of the original color data are detected by said comparison.

2. A color conversion method as claims in claim 1 wherein said value change is performed in a direction corresponding to the increase or decrease direction of the original color data value from said previous pixel to said current pixel.

3. A color conversion apparatus comprising:

conversion means for converting an n-bit original color data supplied for each pixel to an m-bit, new color data, where n is greater than m;

first delay means for delaying the new color data from said conversion means by one pixel;

first comparison means for comparing the new color data from said conversion means with the delayed new color data from said first delay means;

second delay means for delaying said original color data by one pixel;

second comparison means for comparing said original color data with the delayed original color data from said second delay means; and change means for receiving the new color data from said conversion means, and for changing the value of said new color data and sending it to a display unit when a match is detected in said first comparison means and a mismatch is detected in said second comparison means.

4. A color conversion apparatus as claimed in claim 3 wherein said change means is an adder that increases or decreases the value of said new color data by a predetermined amount according to the mismatch detected by said second comparison means.

5. A method of converting a series of original n-bit color data bytes to a series of modified m-bit color data bytes, said method comprising the steps of:

storing a first of said original color data bytes;

converting said first n-bit color data byte to a first new m-bit color data byte;

storing a second of said original color data byte;

converting said second of said original color data bytes to a second new m-bit color data byte;

comparing said first of said original color data bytes with said second of said original color data bytes;

comparing said first of said new color data bytes with said second of said new color data bytes;

modifying said second of said new data bytes in accordance with said comparison.

6. The method of claim 5 wherein:

said change comprises:

changing said second of said new data bytes where said first and second of said original data bytes are not equal and said first and second of said new data bytes are equal.

7. The method of claim 5 wherein:

said change comprises adding a predetermined number to said second of said new data bytes.

8. A color conversion method for converging pixel data bytes, comprising the steps of:

converting an n-bit original color data byte supplied for each pixel to an m-bit new color data byte;

comparing said new color data byte for a current pixel with a new color data byte for a previous pixel;

comparing an original color data byte for said current pixel with an original color data byte for said previous pixel;

wherein said previous pixel immediately precedes said current pixel; and changing said new color data byte of said current pixel when a match of said new color data bytes and a mismatch of said original color data bytes are detected by said comparison.

9. A color conversion method according to claim 1, wherein:

said change in said value of said new color data byte corresponds to an increase or decrease in value of said original color data from said previous pixel to said current pixel.

10. A color conversion method as claimed in claim 9, wherein:

n is greater than m.

11. A color conversion apparatus for converting a data byte of a group of pixels comprising:

conversion means for converting an n-bit original color data byte to an m-bit, new color data byte;

first delay means for delaying said new color data byte from said conversion means by one pixel;

first comparison means for comparing said new color data byte from said conversion means with said delayed new color data byte from said first delay means;

second delay means for delaying said original data byte by one pixel;

second comparison means for comparing said original color data byte with the delayed original color data byte from said second delay means; and change means for receiving said new color data byte from said conversion means, and for changing said new color data byte when a match is detected in said first comparison means and a mismatch is detected in said second comparison means.

12. A color conversion apparatus as claimed in claim 11 wherein:

said change means comprises an adder which increases or decreases the value of said new color data by a predetermined amount according to the mismatch detected by said second comparison means.

* * * * *